US009889540B2

(12) United States Patent
Bird et al.

(10) Patent No.: US 9,889,540 B2
(45) Date of Patent: Feb. 13, 2018

(54) POLYCRYSTALLINE DIAMOND COMPACTS HAVING A MICROSTRUCTURE INCLUDING NANODIAMOND AGGLOMERATES, CUTTING ELEMENTS AND EARTH-BORING TOOLS INCLUDING SUCH COMPACTS, AND RELATED METHODS

(71) Applicant: Baker Hughes Incorporated, Houston, TX (US)

(72) Inventors: Marc W. Bird, Houston, TX (US); Anthony A. DiGiovanni, Houston, TX (US); Valery N. Khabashesku, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 409 days.

(21) Appl. No.: 14/227,900

(22) Filed: Mar. 27, 2014

(65) Prior Publication Data

US 2015/0273661 A1 Oct. 1, 2015

(51) Int. Cl.

| | |
|---|---|
| ***E21B 10/567*** | (2006.01) |
| ***B24D 3/04*** | (2006.01) |
| ***B24D 18/00*** | (2006.01) |
| ***E21B 10/55*** | (2006.01) |

(52) U.S. Cl.
CPC ..... *B24D 3/04* (2013.01); *B24D 18/0009* (2013.01); *E21B 10/55* (2013.01)

(58) Field of Classification Search
USPC ..... 175/434; 51/307
See application file for complete search history.

(56) References Cited

U.S. PATENT DOCUMENTS

| | | | | |
|---|---|---|---|---|
| 8,496,076 | B2 | 7/2013 | DiGiovanni et al. | |
| 8,512,865 | B2 | 8/2013 | DiGiovanni | |
| 2005/0019114 | A1* | 1/2005 | Sung | B21C 3/025 407/119 |
| 2011/0006218 | A1* | 1/2011 | Mochalin | B82Y 30/00 250/459.1 |
| 2011/0031034 | A1 | 2/2011 | DiGiovanni et al. | |
| 2011/0056142 | A1* | 3/2011 | Sheridan | B24D 18/00 51/295 |
| 2011/0061942 | A1 | 3/2011 | DiGiovanni | |
| 2011/0088954 | A1 | 4/2011 | DiGiovanni et al. | |

(Continued)

*Primary Examiner* — Taras P Bemko
(74) *Attorney, Agent, or Firm* — TraskBritt

(57) ABSTRACT

A polycrystalline diamond compact (PDC) has a diamond matrix including inter-bonded diamond grains and nanodiamond agglomerates within interstitial spaces in the diamond matrix. A volume percentage of the nanodiamond agglomerates in the PDC may be greater than or equal to a percolation threshold volume of the nanodiamond agglomerates in the PDC, and a remainder of the volume of the PDC may be at least substantially comprised by the diamond matrix. The PDC may be at least substantially free of metal solvent catalyst material. Earth-boring tools include one or more such PDCs. A method of manufacturing a PDC includes mixing diamond grains with nanodiamond agglomerates to form a mixture, and subjecting the mixture to a high-temperature/high-pressure (HTHP) sintering process to form the PDC without any substantial assistance from a metal solvent catalyst material.

18 Claims, 4 Drawing Sheets

(56) References Cited

U.S. PATENT DOCUMENTS

| | | | | |
|---|---|---|---|---|
| 2011/0139514 | A1* | 6/2011 | Voronin | C01B 31/065 175/428 |
| 2011/0252711 | A1* | 10/2011 | Chakraborty | B01J 3/062 51/298 |
| 2012/0034464 | A1 | 2/2012 | Chakraborty et al. | |
| 2012/0037431 | A1 | 2/2012 | DiGiovanni et al. | |
| 2012/0080239 | A1* | 4/2012 | Lyons | B24D 99/005 175/428 |
| 2012/0208906 | A1* | 8/2012 | Wu | B28B 7/30 521/25 |
| 2013/0068540 | A1 | 3/2013 | DiGiovanni | |
| 2013/0068541 | A1 | 3/2013 | DiGiovanni et al. | |
| 2013/0092454 | A1 | 4/2013 | Scott et al. | |

* cited by examiner

POLYCRYSTALLINE DIAMOND COMPACTS HAVING A MICROSTRUCTURE INCLUDING NANODIAMOND AGGLOMERATES, CUTTING ELEMENTS AND EARTH-BORING TOOLS INCLUDING SUCH COMPACTS, AND RELATED METHODS

FIELD

The disclosure relates to polycrystalline diamond compacts (PDCs), which are used in cutting elements such as cutting elements for earth-boring tools, to cutting elements and earth-boring tools including such cutting elements, and to methods of manufacturing such PDCs, cutting elements, and earth-boring tools.

BACKGROUND

Earth-boring tools for forming wellbores in subterranean earth formations generally include a plurality of cutting elements secured to a body. For example, fixed-cutter earth-boring rotary drill bits (also referred to as "drag bits") include a plurality of cutting elements that is fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond compact (often referred to as "PDC") cutting elements, which are cutting elements that include cutting faces of a polycrystalline diamond material. Polycrystalline diamond material is material that includes inter-bonded grains or crystals of diamond material. In other words, polycrystalline diamond material includes direct, intergranular bonds between the grains or crystals of diamond material. The terms "grain" and "crystal" are used synonymously and interchangeably herein.

Polycrystalline diamond compact cutting elements are traditionally formed by sintering and bonding together relatively small diamond grains under conditions of high temperature and high pressure in the presence of a catalyst (such as, for example, cobalt, iron, nickel, or alloys and mixtures thereof) to form a layer or "table" of polycrystalline diamond material on a cutting element substrate. These processes are often referred to as high-temperature/high-pressure (or "HTHP") processes. The cutting element substrate may comprise a cermet material (i.e., a ceramic-metal composite material) such as, for example, cobalt cemented tungsten carbide. In such instances, the cobalt (or other metal solvent catalyst material) in the cutting element substrate may be swept into the diamond grains during sintering and serve as the metal solvent catalyst material for forming the intergranular diamond-to-diamond bonds between, and the resulting diamond table from, the diamond grains. In other methods, powdered metal solvent catalyst material may be mixed with the diamond grains prior to sintering the grains together in a HTHP process.

Upon formation of a diamond table using an HTHP process, metal solvent catalyst material may remain in interstitial spaces between the grains of diamond in the resulting polycrystalline diamond table. The presence of the metal solvent catalyst material in the diamond table may contribute to thermal damage in the diamond table when the cutting element is heated during use, due to friction at the contact point between the cutting element and the formation.

Polycrystalline diamond compact cutting elements in which the metal solvent catalyst material remains in the diamond table are generally thermally stable up to a temperature of about seven hundred fifty degrees Celsius (750° C.), although internal stress within the cutting element may begin to develop at temperatures exceeding about four hundred degrees Celsius (400° C.) due to a phase change that occurs in cobalt at that temperature (a change from the "beta" phase to the "alpha" phase). Also beginning at about four hundred degrees Celsius (400° C.), there is an internal stress component that arises due to differences in the thermal expansion of the diamond grains and the catalyst metal at the grain boundaries. This difference in thermal expansion may result in relatively large tensile stresses at the interface between the diamond grains, and contributes to thermal degradation of the microstructure when polycrystalline diamond compact cutting elements are used in service. Differences in the thermal expansion between the diamond table and the cutting element substrate to which it is bonded further exacerbate the stresses in the polycrystalline diamond compact. This differential in thermal expansion may result in relatively large compressive and/or tensile stresses at the interface between the diamond table and the substrate that eventually lead to the deterioration of the diamond table, cause the diamond table to delaminate from the substrate, or result in the general ineffectiveness of the cutting element.

Furthermore, at temperatures at or above about seven hundred fifty degrees Celsius (750° C.), some of the diamond crystals within the diamond table may react with the metal solvent catalyst material causing the diamond crystals to undergo a chemical breakdown or conversion to another allotrope of carbon. For example, the diamond crystals may graphitize at the diamond crystal boundaries, which may substantially weaken the diamond table. Also, at extremely high temperatures, in addition to graphite, some of the diamond crystals may be converted to carbon monoxide and carbon dioxide.

In order to reduce the problems associated with differences in thermal expansion and chemical breakdown of the diamond crystals in polycrystalline diamond cutting elements, so called "thermally stable" polycrystalline diamond compacts (which are also known as thermally stable products, or "TSPs") have been developed. Such a thermally stable polycrystalline diamond compact may be formed by leaching the metal solvent catalyst material (e.g., cobalt) out from interstitial spaces between the inter-bonded diamond crystals in the diamond table using, for example, an acid or combination of acids (e.g., aqua regia). A substantial amount of the metal solvent catalyst material may be removed from the diamond table, or metal solvent catalyst material may be removed from only a portion thereof. Thermally stable polycrystalline diamond compacts in which substantially all metal solvent catalyst material has been leached out from the diamond table have been reported to be thermally stable up to temperatures of about twelve hundred degrees Celsius (1,200° C.). It has also been reported, however, that such fully leached diamond tables are relatively more brittle and vulnerable to shear, compressive, and tensile stresses than are non-leached diamond tables. In addition, it is difficult to secure a completely leached diamond table to a supporting substrate. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which the metal solvent catalyst material has been leached from a portion or portions of the diamond table. For example, it is known to leach metal solvent catalyst material from the cutting face, from the side of the diamond table, or both, to a desired depth within the diamond table, but without leaching all of the metal solvent catalyst material out from the diamond table.

BRIEF SUMMARY

In some embodiments, the present disclosure includes a polycrystalline diamond compact (PDC) having a diamond matrix including inter-bonded diamond grains bonded directly together by diamond-to-diamond bonds, and nanodiamond agglomerates including agglomerated nanodiamond grains. The nanodiamond agglomerates are disposed within interstitial spaces between the inter-bonded diamond grains of the diamond matrix. A volume percentage of the nanodiamond agglomerates in the PDC may be greater than or equal to a percolation threshold volume of the nanodiamond agglomerates in the PDC, and a remainder of the volume of the PDC may be at least substantially comprised by the diamond matrix. The PDC is at least substantially free of metal solvent catalyst material.

In additional embodiments, the present disclosure includes earth-boring tools that include one or more such PDCs.

In still other embodiments, the present disclosure includes a method of fabricating a PDC. The method includes mixing diamond grains with nanodiamond agglomerates to form a mixture, and subjecting the mixture to a high-temperature/high-pressure (HTHP) sintering process and forming the PDC without any substantial assistance from a metal solvent catalyst material. The HTHP sintering process results in formation of diamond-to-diamond inter-granular bonds between the diamond grains to define a diamond matrix. The nanodiamond agglomerates are disposed within interstitial spaces between the inter-bonded diamond grains of the diamond matrix. A volume percentage of the nanodiamond agglomerates in the PDC may be greater than or equal to a percolation threshold volume of the nanodiamond agglomerates in the PDC, and a remainder of the volume of the PDC may be at least substantially comprised by the diamond matrix.

BRIEF DESCRIPTION OF THE DRAWINGS

While the disclosure concludes with claims particularly pointing out and distinctly claiming embodiments of the invention, various features and advantages of example embodiments of polycrystalline diamond compacts (PDCs) are described below with reference to the accompanying figures, in which:

DETAILED DESCRIPTION

The illustrations presented herein are not meant to be actual views of any particular material, polycrystalline compact, cutting element, or earth-boring tool, but are merely idealized representations employed to describe illustrative embodiments of the disclosure. The figures are not drawn to scale.

Figure 1:
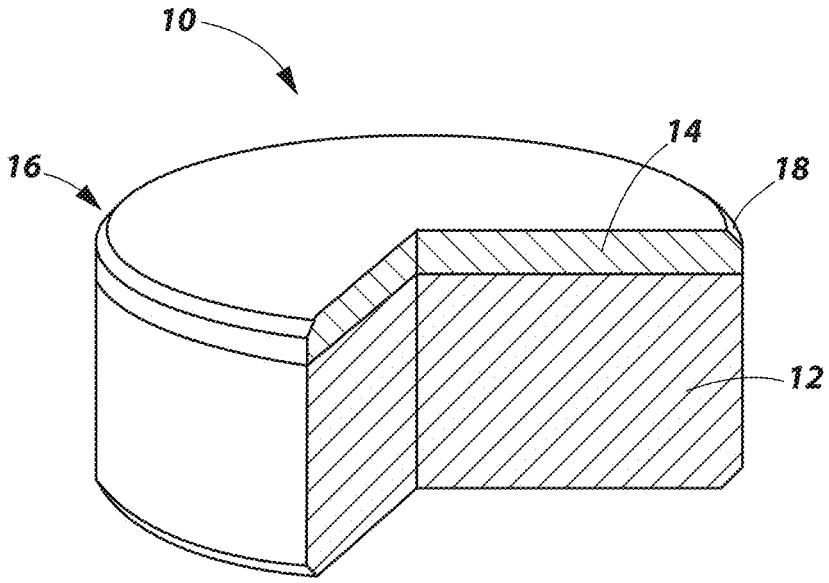
FIG. 1 is a partially cut-away perspective view of a PDC cutting element.

FIG. 1 is a partially cut-away perspective view of a polycrystalline diamond compact (PDC) cutting element 10. The cutting element 10 includes a cutting element substrate 12, and a volume of polycrystalline diamond 14 on the substrate 12. The volume of polycrystalline diamond 14 may be formed on the cutting element substrate 12, or the volume of polycrystalline diamond 14 and the substrate 12 may be separately formed and subsequently attached together. The volume of polycrystalline diamond 14 may have a chamfered cutting edge 16. The chamfered cutting edge 16 of the cutting element 10 has a single chamfer surface 18, although the chamfered cutting edge 16 also may have additional chamfer surfaces, and such chamfer surfaces may be oriented at any of various chamfer angles, as known in the art.

Figure 2:
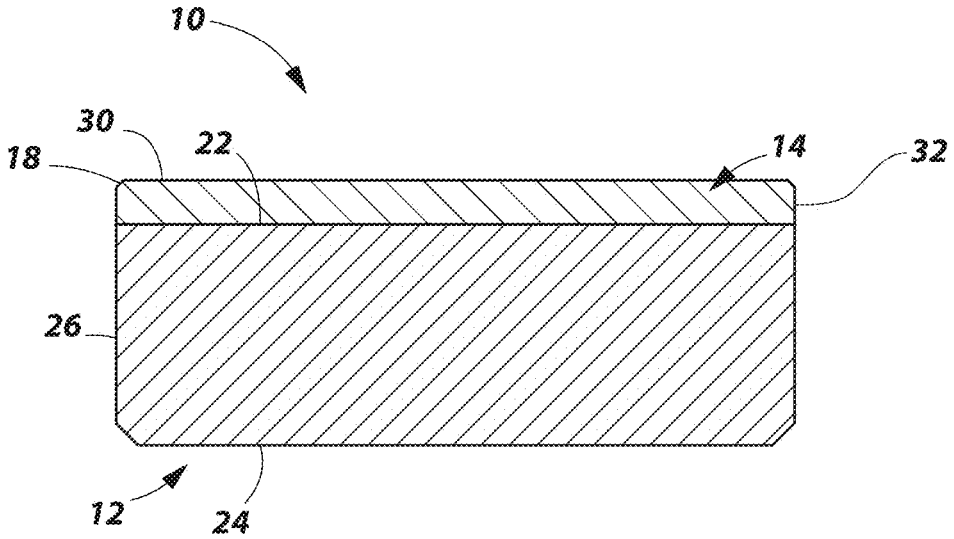
FIG. 2 is a cross-sectional side view of the PDC cutting element of FIG. 1.

The cutting element substrate 12 may have a generally cylindrical shape, as shown in FIGS. 1 and 2. Referring to FIG. 2, the cutting element substrate 12 may have an at least substantially planar first end surface 22, an at least substantially planar second end surface 24, and a generally cylindrical lateral side surface 26 extending between the first end surface 22 and the second end surface 24.

Although the end surface 22 shown in FIG. 2 is at least substantially planar, it is well known in the art to employ non-planar interface geometries between substrates and diamond tables formed thereon, and additional embodiments of the present disclosure may employ such non-planar interface geometries at the interface between the substrate 12 and the volume of polycrystalline diamond 14. Additionally, although cutting element substrates commonly have a cylindrical shape, like the cutting element substrate 12, other shapes of cutting element substrates are also known in the art, and embodiments of the present invention include cutting elements having shapes other than a generally cylindrical shape.

The cutting element substrate 12 may be formed from a material that is relatively hard and resistant to wear. For example, the cutting element substrate 12 may be fainted from and include a ceramic-metal composite material (which are often referred to as "cermet" materials). The cutting element substrate 12 may include a cemented carbide material, such as a cemented tungsten carbide material, in which tungsten carbide particles are cemented together in a metallic binder material. The metallic binder material may include, for example, cobalt, nickel, iron, or alloys and mixtures thereof.

With continued reference to FIGS. 1 and 2, the volume of polycrystalline diamond 14 may be disposed on or over the first end surface 22 of the cutting element substrate 12. The volume of polycrystalline diamond 14 has a front cutting face 30 and a lateral side surface 32. The cutting edge 16 is defined between the front cutting face 30 and the lateral side surface 32 of the volume of polycrystalline diamond 14.

Figure 3:
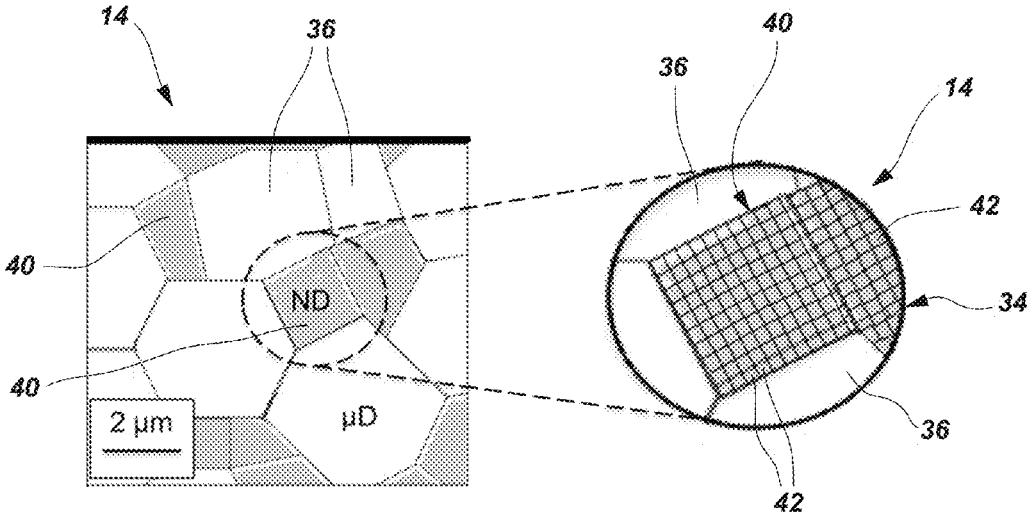
FIG. 3 is an enlarged view illustrating how a microstructure of the polycrystalline diamond of the PDC cutting element of FIG. 1 may appear under magnification.

The volume of polycrystalline diamond 14 may comprise grains or crystals of diamond that are bonded directly together by inter-granular diamond-to-diamond bonds to form the polycrystalline diamond. FIG. 3 is a simplified drawing illustrating how a microstructure of the volume of polycrystalline diamond 14 of the cutting element 10 may appear under magnification. As shown in FIG. 3, the volume of polycrystalline diamond 14 may have a diamond matrix 34 that includes inter-bonded diamond grains 36 bonded directly together by diamond-to-diamond bonds. Nanodiamond agglomerates 40 are disposed within interstitial spaces between the inter-bonded diamond grains 36 of the diamond matrix 34. The nanodiamond agglomerates 40 include agglomerated nanodiamond grains 42. The nanodiamond grains 42 are also bonded directly together by diamond-to-diamond inter-granular bonds, and the nanodiamond grains 42 are bonded directly to any adjacent diamond grains 36 of the diamond matrix 34 by inter-granular diamond-to-diamond bonds. Thus, the polycrystalline diamond 14 of the cutting element 10 may be characterized as having a diamond-to-diamond composite microstructure (DDCM).

The volume of polycrystalline diamond 14 is primarily comprised of diamond grains. In other words, diamond grains may comprise at least about ninety-six percent (96%) by volume of the volume of polycrystalline diamond 14. In additional embodiments, the diamond grains may comprise at least about ninety-eight percent (98%) by volume of the volume of polycrystalline diamond 14, and in yet further embodiments, the diamond grains may comprise at least about ninety-nine percent (99%) by volume of the volume of polycrystalline diamond 14.

The polycrystalline diamond 14 of the PDC cutting element 10 may be at least substantially free of metal solvent catalyst material throughout at least a majority of the body of the polycrystalline diamond 14, although, in some embodiments, there may be some metal solvent catalyst material in the polycrystalline diamond 14 of the PDC cutting element 10 proximate the surface of the cutting element substrate 12. In particular, if the cutting element substrate 12 includes a metal solvent catalyst material, some quantity of metal solvent catalyst material may migrate a relatively small distance into the body of the polycrystalline diamond 14, although at least a majority of the volume of the polycrystalline diamond 14 may be free of metal solvent catalyst material. In other embodiments, the polycrystalline diamond 14 of the PDC cutting element 10 may be entirely free of metal solvent catalyst material throughout the polycrystalline diamond 14.

As discussed in further detail below, the polycrystalline diamond 14 may be fabricated in a high-temperature/high-pressure (HTHP) sintering process without any substantial assistance from a metal solvent catalyst material (although there may be some relatively small assistance resulting from the presence of a relatively small quantity of metal solvent catalyst material migrating into the polycrystalline diamond 14 from the substrate 12). As used herein, the term "metal solvent catalyst material" means and includes Group VIII metals (including alloys and mixtures of such metals). It is believed that the presence of the nanodiamond grains (e.g., crystallites) in the nanodiamond agglomerates 40, when present in a volume sufficient to form a continuous network of nanodiamond agglomerates 40 within the polycrystalline diamond 14, facilitates the HTHP sintering process by promoting compactions, sintering, and densification of the polycrystalline diamond 14 during fabrication thereof and by providing a high number of nucleation sites (on the nanodiamond grains), which may lower the surface energy of the relatively larger diamond grains 36.

In conventional previously known HTHP sintering processes used to form polycrystalline diamond from diamond grit, the diamond grit must be subjected to ultra-high pressures (e.g., greater than about 8.0 GPa) and temperatures greater than about 1,600° C. to achieve densification in the absence of a metal solvent catalyst material. It is believed that by employing nanodiamond agglomerates 40 as described herein, the pressures and temperatures required to achieve densification in the absence of metal solvent catalyst material may be reduced. For example, it may be possible to form the polycrystalline diamond 14 using an HTHP process carried out at pressures below about 6.0 GPa and temperatures of about 1,600° C. or less.

In some embodiments, the nanodiamond agglomerates 40 may comprise a volume of the polycrystalline diamond 14 that is equal to or greater than a percolation threshold for the nanodiamond agglomerates 40 in the polycrystalline diamond 14. For purposes of this document, the term "percolation threshold" means $P_T$, as defined by Equation 1 below.

$$P_T = \frac{6P'[1 + (P'^{(\phi-1)} - 1)/14]}{(5 + \phi)}, \qquad \text{Equation 1}$$

wherein $P_T$ is the percolation threshold, Φ is the average aspect ratio (length/width) of the nanodiamond agglomerates 40, and P' is defined by Equation 2 below.

$$P' = \frac{1.359}{Z} + 0.08, \qquad \text{Equation 2}$$

wherein Z represents a coordination packing number calculated using Equation 3 below.

$$V_f = \frac{(Z-2)^2}{(Z^2 - 0.6Z + 1.76)}, \qquad \text{Equation 3}$$

wherein $V_f$ is the volume fraction of the nanodiamond agglomerates 40 in the polycrystalline diamond 14. The volume fraction $V_f$ of nanodiamond agglomerates 40 in a polycrystalline diamond 14 may be determined by analyzing the area fraction of the nanodiamond agglomerates 40 in one or more two-dimensional images of the microstructure of a volume of polycrystalline diamond 14, and then estimating the three-dimensional volume fraction $V_f$ based on the measured two-dimensional area fraction using standard techniques known in the art of microstructural analysis. Thus, once the volume fraction $V_f$ is determined from the measured two-dimensional area fraction, Equation 3 above can be solved for the value of Z using standard computational methods. The value of Z then allows calculation of the value of P' from Equation 2 above. The same two-dimensional images of the microstructure used to measure the area fraction of the nanodiamond agglomerates 40 can be analyzed to measure the average aspect ratio Φ (length/width) of the nanodiamond agglomerates 40. The percolation threshold $P_T$ then may be calculated from Equation 3 above using the calculated value of P' and the measured average aspect ratio Φ of the nanodiamond agglomerates 40.

The percolation threshold volume for the nanodiamond agglomerates 40 in the polycrystalline diamond 14 is approximately the minimum volume needed to form an at least substantially continuous phase of the nanodiamond agglomerates 40 through the polycrystalline diamond 14. Thus, in some embodiments, the inter-bonded relatively larger diamond grains 36 may define a first at least substantially continuous phase of the DDCM, and the inter-bonded nanodiamond agglomerates 40 may define a second at least substantially continuous phase of the DDCM. In other embodiments, either the phase of the DDCM defined by the relatively larger diamond grains 36 or the phase of the DDCM defined by the nanodiamond agglomerates 40 may be a discontinuous phase.

In some embodiments, the nanodiamond agglomerates 40 may comprise at least about ten percent by volume (10 vol %), at least about twenty percent by volume (20 vol %), or even at least about twenty-five percent by volume (25 vol %) of the polycrystalline diamond 14, and a remainder of the volume of the polycrystalline diamond 14 may be at least substantially comprised by the diamond matrix 34. As a non-limiting example, in some embodiments, the nanodiamond agglomerates 40 may comprise between about twenty percent by volume (20 vol %) and about fifty percent by volume (50 vol %), and a remainder of the volume of the polycrystalline diamond 14 may be at least substantially comprised by the diamond matrix 34.

With continued reference to FIG. 3, the diamond grains 36 of the diamond matrix 34 may be relatively larger than the nanodiamond grains 42 of the nanodiamond agglomerates 40, and the nanodiamond grains 42 may be relatively smaller than the diamond grains 36. By way of example and not limitation, the diamond grains 36 of the diamond matrix 34 may comprise microdiamond grains having a mean particle size between about one micron (1 μm) and about five hundred microns (500 μm), between about one micron (1 μm) and about one hundred microns (100 μm), or even between about one micron (1 μm) and about thirty microns (30 μm). The nanodiamond grains 42 of the nanodiamond agglomerates 40 may have a mean particle size between about ten nanometers (10 nm) and about five hundred nanometers (500 nm). In some embodiments, the nanodiamond grains 42 may comprise crushed nanodiamond grains. Such crushed nanodiamond grains may be at least substantially free of carbonaceous residue including non-sp3 carbon. In other embodiments, the nanodiamond grains may comprise what is referred to in the art as "detonation" nanodiamond grains that are formed through the detonation of an explosive. Such detonation nanodiamond grains may contain a relatively higher amount of carbonaceous residue including non-sp3 carbon. Crushed nanodiamond grains may also include relatively lower amounts of oxygen and nitrogen atomic impurities compared to detonation nanodiamond grains.

The nanodiamond agglomerates 40 may have a mean agglomerate size that is within about fifty percent (50%), within about twenty-five percent (25%), or even within about fifteen percent (15%) of a mean particle size of the diamond grains 36 of the diamond matrix 34. A non-limiting specific example of such an embodiment is described below with reference to FIGS. 4 and 5.

Figure 4:
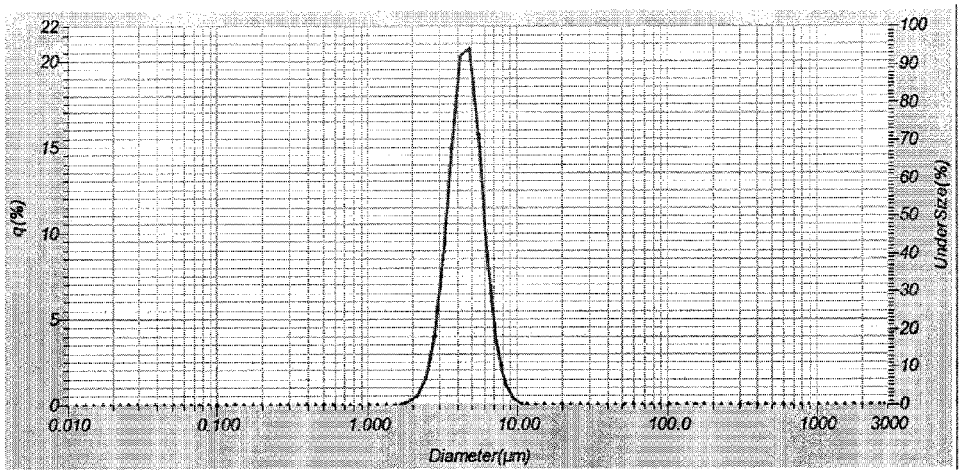
FIG. 4 is a graph of a particle size distribution for diamond grains forming a diamond matrix in the microstructure of the polycrystalline diamond of the PDC cutting element of FIGS. 1 through 3.

FIG. 4 is a graph illustrating a specific non-limiting example of a particle size distribution for monocrystalline diamond grains, prior to an HTHP sintering process, which may be used to form the diamond grains 36 of the diamond matrix 34 in the formation of the polycrystalline diamond 14. The diamond grains of FIG. 4 have a mean size of approximately five microns (5 μm) (e.g., 4.6 μm) and a standard deviation of approximately one micron (1 μm) (e.g., 1.2 μm). Furthermore, the particle size distribution of the diamond grains of FIG. 4 is mono-modal and has a substantially Gaussian distribution. In other embodiments, the distribution may be multi-modal (e.g., bi-modal, tri-modal, etc.) and the distribution may not be Gaussian.

Figure 5:
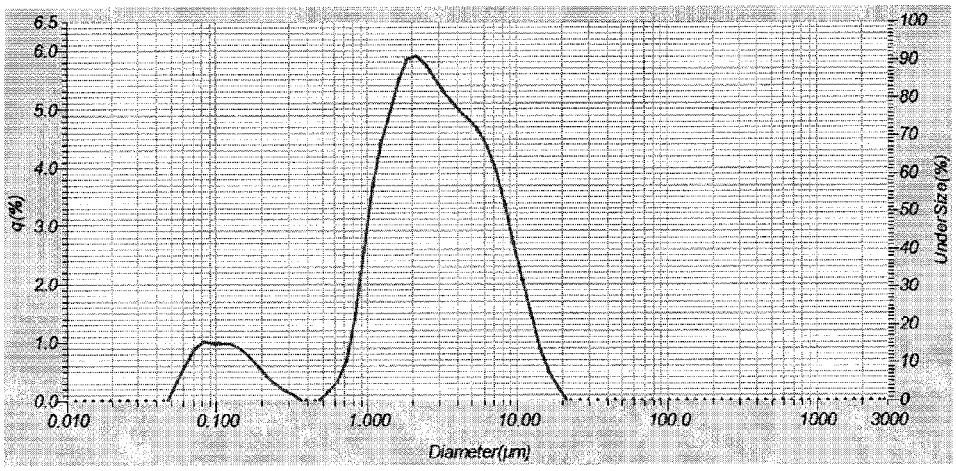
FIG. 5 is a graph of a agglomerate size distribution for nanodiamond agglomerates disposed in interstitial spaces of the diamond matrix in the microstructure of the polycrystalline diamond of the PDC cutting element of FIGS. 1 through 3.

FIG. 5 is a graph illustrating a specific non-limiting example of a agglomerate size distribution for nanodiamond agglomerates, prior to an HTHP sintering process, which may be used (in combination with the diamond grains of the distribution of FIG. 4) to form the nanodiamond agglomerates 40 of the polycrystalline diamond 14. The nanodiamond agglomerates of FIG. 5 have a mean size of approximately four microns (4 μm) (e.g., 3.6 μm) and a standard deviation of approximately three microns (3 μm) (e.g., 3.2 μm). The agglomerate size distribution of FIG. 5 is bi-modal, with the peak of a first mode at approximately one hundred nanometers (100 nm) and the peak of a second mode at approximately two microns (2 μm). The first mode corresponds to individual nanodiamond grains (such as the nanodiamond grains 42 of FIG. 3) that have dissociated from nanodiamond agglomerates, while the second mode corresponds to the nanodiamond agglomerates (such as the nanodiamond agglomerates 40 of FIG. 3). Ignoring the first mode corresponding to the dissociated individual nanodiamond grains, the nanodiamond agglomerates may have a mono-modal agglomerate size distribution. In other embodiments, however, the agglomerate size distribution of the nanodiamond agglomerates 40 may be multi-modal (e.g., bi-modal, tri-modal, etc.). Additionally, the distribution of the nanodiamond agglomerates 40 may be Gaussian or non-Gaussian.

It can be seen from FIGS. 4 and 5 that the nanodiamond agglomerates 40 of FIG. 5 have a mean agglomerate size of approximately 3.6 μm, which is within about twenty-two percent (22%) of the mean particle size of the diamond grains 36 of FIG. 4, which is approximately 4.6 μm (i.e., $((4.6-3.6)/4.6)\times100=22$).

To prepare the diamond grains 36 and the nanodiamond agglomerates 40 for the HTHP sintering process, synthetic or natural diamond grains 36 may be employed with nanodiamond agglomerates 40 comprising crushed and/or detonated nanodiamond grains. In conventional previously known processes involving the use of nanodiamond grains in the formation of PDC, the nanodiamond grains are well-dispersed in a polar solvent using ultrasonic agitation to break the attractive forces between the individual nanodiamond grains. In embodiments of the present disclosure, the proposed structure involves the use of nanodiamond agglomerates 40. Thus, the starting diamond powder may include dry, well-agglomerated nanodiamond grains forming the nanodiamond agglomerates 40. A relatively large percentage of the nanodiamond agglomerates 40 may have a size on the order of the relatively larger diamond grains 36 for improved crack deflection and associated fracture toughness.

Wet ball milling or attritor milling of the nanodiamond agglomerates 40 and the relatively larger diamond grains 36 may be used to control the size distribution of the nanodiamond agglomerates 40 and the diamond grains 36. Milling may promote mixing and de-agglomeration of larger nanodiamond agglomerates 40, and may be carried out in a solvent having a low vapor pressure, such as isopropyl alcohol or hexane. A surfactant may be employed in the milling mixture to further promote de-agglomeration of larger nanodiamond agglomerates 40. Milling times will vary depending on the milling technique employed. Typical ball milling times may be on the order of days, while attritor milling times may be on the order of hours. After milling and/or mixing with grinding media, the media slurry including the diamond grains 36 and the nanodiamond agglomerates 40 may be rinsed and dried to form a thick paste or powder cake. After the solvent has evaporated, the paste or powder cake may be dried for an additional time at temperatures between about 150° C. and about 250° C. to complete the drying process. Upon drying, the resulting powder may be pulverized and sieved (e.g., using a number 100 mesh nylon sieve) to reduce contamination. After sieving, the resulting diamond powder then may be subjected to an HTHP sintering process to form the PDC as previously described.

Although any combination of temperature and pressure may be used that results in a PDC microstructure as described herein, Table 1 below provides example pressure ranges that may be employed at different sintering temperatures in an HTHP process according to embodiments of the disclosure to form a PDC microstructure as described herein.

TABLE 1

| Temperature (° C.) | Pressure (GPa) |
|---|---|
| 1,400 | 5.0-10.0 |
| 1,500 | 5.5-10.0 |
| 1,600 | 5.8-10.0 |
| 1,700 | 6.0-10.0 |
| 1,800 | 6.4-10.0 |

Although higher temperatures than those set forth in Table 1 may be employed, pressing time durations should be considered to avoid significant grain growth of the diamond grains. Typical pressing times at maximum sintering temperature for a given HTHP cycle implementing an embodiment of the disclosure may range from thirty seconds to ten minutes or more, depending on the temperature and pressure conditions, desired bonding and densification, and grain growth characteristics.

The improvements in diamond bonding and increased diamond density that may be attained through embodiments of the present disclosure may promote increases in the modulus and fracture toughness of the polycrystalline diamond 14. The presence of the nanodiamond agglomerates 40 in the polycrystalline diamond 14 may improve the quasi-static fracture behavior of the cutting elements 10 by transitioning fracture mechanic behavior from predominantly trans-granular cleavage to mixed inter- and trans-granular fracture by acting as crack deflectors and promoting crack twisting. In other words, the nanodiamond agglomerates 40 may promote crack deflection, twisting, and accompanying variation in the fracture path of cracks propagating through the polycrystalline diamond 14. Such changes in the fracture path may improve the effective fracture toughness of the polycrystalline diamond 14.

Thus, embodiments of cutting elements 10 as described herein may exhibit improved effective fracture toughness. The effective fracture toughness $K_{eff}$ is comprised of intrinsic material fractures toughness $K_{eff}$ and extrinsic fracture toughness $K_{ext}$. The intrinsic material fractures toughness $K_{eff}$ is a function of the chemical nature and growth defect structure of the material itself, whereas the extrinsic fracture toughness $K_{ext}$ is at least partially a function of the microstructure of the material. The presence of the nanodiamond agglomerates 40 as described hereinabove may promote an increase in the extrinsic fracture toughness $K_{ext}$ by causing deflection and twisting of cracks propagating through the polycrystalline diamond 14, resulting in an increase in the overall effective fracture toughness $K_{eff}$. The extrinsic fracture toughness $K_{ext}$ and the effective fracture toughness $K_{eff}$ of the polycrystalline diamond 14 increase with increasing crack deflection and twisting angle θ. The presence of the nanodiamond agglomerates 40 in the microstructure as described herein may increase the crack deflection and twisting angle θ, and, thus, may improve the extrinsic fracture toughness $K_{ext}$ and the effective fracture toughness $K_{eff}$ exhibited by the polycrystalline diamond 14.

Embodiments of the present disclosure also may exhibit improved thermal stability by at least substantially avoiding the presence of metal solvent catalyst material in the polycrystalline diamond microstructure. Metal solvent catalyst materials, when present in the microstructure of polycrystalline diamond, result in the development of large internal stresses caused by thermal expansion mismatch upon heating during use, and may contribute to reversion of diamond to graphite at the elevated temperatures encountered during use. Additionally, abrasion resistance improvements may be realized from the near 100% diamond microstructure.

Embodiments of cutting elements of the present invention, such as the PDC cutting element 10 previously described herein with reference to FIGS. 1 through 3, may be used to form embodiments of earth-boring tools of the present invention.

Figure 6:
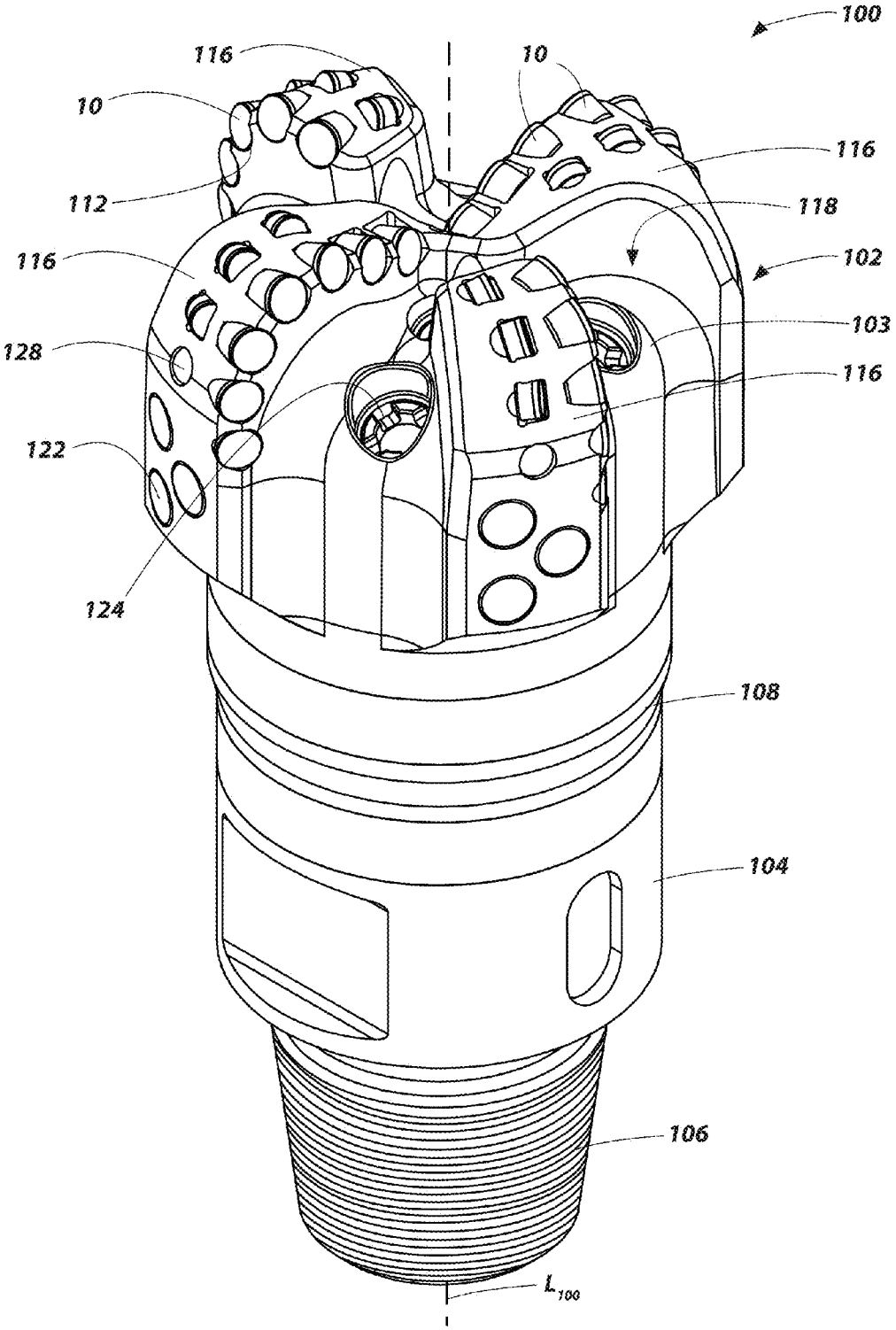
FIG. 6 is a perspective view of an embodiment of an earth-boring tool in the form of a fixed-cutter earth-boring rotary drill bit, which may include a plurality of PDC cutting elements like that shown in FIGS. 1 through 3.

FIG. 6 is a perspective view of an embodiment of an earth-boring rotary drill bit 100 of the present invention that includes a plurality of cutting elements 10 like those shown in FIGS. 1 through 3, although, the drill bit 100 may include any other cutting elements according to the present disclosure in additional embodiments. The earth-boring rotary drill bit 100 includes a bit body 102 that is secured to a shank 104 having a threaded connection portion 106 (e.g., an American Petroleum Institute (API) threaded connection portion) for attaching the drill bit 100 to a drill string (not shown). In some embodiments, such as that shown in FIG. 6, the bit body 102 may comprise a particle-matrix composite material, and may be secured to the metal shank 104 using an extension 108. In other embodiments, the bit body 102 may be secured to the shank 104 using a metal blank embedded within the particle-matrix composite bit body 102, or the bit body 102 may be secured directly to the shank 104.

The bit body 102 may include internal fluid passageways (not shown) that extend between the face 103 of the bit body 102 and a longitudinal bore (not shown), which extends through the shank 104, the extension 108, and partially through the bit body 102. Nozzle inserts 124 also may be provided at the face 103 of the bit body 102 within the internal fluid passageways. The bit body 102 may further include a plurality of blades 116 that are separated by junk slots 118. In some embodiments, the bit body 102 may include gage wear plugs 122 and wear knots 128. A plurality of cutting elements 10 as previously disclosed herein, may be mounted on the face 103 of the bit body 102 in cutting element pockets 112 that are located along each of the blades 116. The cutting elements 10 are positioned to cut a subterranean formation being drilled while the drill bit 100 is rotated under weight-on-bit (WOB) in a borehole about centerline $L_{100}$.

The PDC cutting elements 10 described herein, or any other cutting elements according to the present disclosure, may be used on other types of earth-boring tools. As non-limiting examples, embodiments of cutting elements of the present disclosure also may be used on cones of roller cone drill bits, on reamers, mills, bi-center bits, eccentric bits, coring bits, and so-called "hybrid bits" that include both fixed cutters and rolling cutters.

Additional, non-limiting example embodiments of the disclosure are set forth below.

Embodiment 1

A polycrystalline diamond compact (PDC), comprising: a diamond matrix including inter-bonded diamond grains bonded directly together by diamond-to-diamond bonds; and nanodiamond agglomerates including agglomerated nanodiamond grains, the nanodiamond agglomerates disposed within interstitial spaces between the inter-bonded diamond grains of the diamond matrix; wherein a volume percentage of the nanodiamond agglomerates in the PDC is greater than or equal to a percolation threshold volume of the nanodiamond agglomerates in the PDC, and a remainder of the volume of the PDC is at least substantially comprised by the diamond matrix, and wherein the PDC is at least substantially free of metal solvent catalyst material.

Embodiment 2

The PDC of Embodiment 1, wherein the PDC comprises at least about ninety-six percent by volume (96 vol %) diamond.

Embodiment 3

The PDC of Embodiment 1, wherein the nanodiamond agglomerates comprise at least about ten percent by volume (10 vol %) of the PDC, or even at least about twenty percent by volume (20 vol %) of the PDC.

Embodiment 4

The PDC of Embodiment 3, wherein the nanodiamond agglomerates in the PDC define a continuous phase within the PDC.

Embodiment 5

The PDC of Embodiment 1, wherein the inter-bonded diamond grains of the diamond matrix have a mean particle size of between about one micron (1 μm) and about thirty microns (30 μm).

Embodiment 6

The PDC of Embodiment 1, wherein the nanodiamond grains of the diamond agglomerates have a mean particle size of between about ten nanometers (10 nm) and about five hundred nanometers (500 nm).

Embodiment 7

The PDC of Embodiment 1, wherein the nanodiamond grains comprise crushed nanodiamond grains.

Embodiment 8

The PDC of Embodiment 1, wherein the nanodiamond grains comprise detonation nanodiamond grains.

Embodiment 9

The PDC of Embodiment 1, wherein the nanodiamond agglomerates have a mean agglomerate size within about fifty percent (50%) of a mean particle size of the inter-bonded diamond grains of the diamond matrix.

Embodiment 10

The PDC of Embodiment 9, wherein the nanodiamond agglomerates have a mean agglomerate size within about twenty-five percent (25%) of a mean particle size of the inter-bonded diamond grains of the diamond matrix.

Embodiment 11

A method of fabricating a polycrystalline diamond compact (PDC), comprising: mixing diamond grains with nanodiamond agglomerates to form a mixture; and subjecting the mixture to a high-temperature/high-pressure (HTHP) sintering process and forming the PDC without any substantial assistance from a metal solvent catalyst material, the HTHP sintering process resulting in formation of diamond-to-diamond inter-granular bonds between the diamond grains to define a diamond matrix, the nanodiamond agglomerates disposed within interstitial spaces between the inter-bonded diamond grains of the diamond matrix, a volume percentage of the nanodiamond agglomerates in the PDC being greater than or equal to a percolation threshold volume of the nanodiamond agglomerates in the PDC, a remainder of the volume of the PDC being at least substantially comprised by the diamond matrix.

Embodiment 12

The method of Embodiment 11, wherein subjecting the mixture to the HTHP sintering process comprises subjecting the mixture to temperatures between about 1,400° C. and about 1,800° C. and pressures between about 5.0 GPa and about 10.0 GPa.

Embodiment 13

The method of Embodiment 12, wherein subjecting the mixture to the HTHP sintering process comprises subjecting the mixture to temperatures between about 1,400° C. and about 1,600° C. and pressures between about 5.0 GPa and about 7.5 GPa.

Embodiment 14

The method of Embodiment 11, further comprising forming the PDC to comprise at least about ninety-six percent by volume (96 vol %) diamond.

Embodiment 15

The method of Embodiment 11, further comprising forming the PDC such that the nanodiamond agglomerates comprise at least about ten percent by volume (10 vol %) of the PDC, or even at least about twenty percent by volume (20 vol %) of the PDC.

Embodiment 16

The method of Embodiment 15, further comprising forming the PDC such that the nanodiamond agglomerates comprise a volume of the PDC equal to or greater than a percolation threshold volume of the PDC.

Embodiment 17

The method of Embodiment 11, further comprising selecting the diamond grains to have a mean particle size of between about one micron (1 μm) and about thirty microns (30 μm).

Embodiment 18

The method of Embodiment 11, further comprising selecting the nanodiamond grains of the diamond agglomerates to have a mean agglomerate size of between about ten nanometers (10 nm) and about five hundred nanometers (500 nm).

Embodiment 19

The method of Embodiment 11, further comprising selecting the diamond grains and the nanodiamond agglomerates such that the nanodiamond agglomerates have a mean agglomerate size within about fifty percent (50%) of a mean particle size of the diamond grains.

Embodiment 20

The method of Embodiment 19, further comprising selecting the diamond grains and the nanodiamond agglomerates such that the nanodiamond agglomerates have a mean agglomerate size within about twenty-five percent (25%) of a mean particle size of the diamond grains.

Embodiment 21

An earth-boring tool, comprising: a body; and at least one polycrystalline diamond compact (PDC) as recited in any of Embodiments 1 through 10 secured to the body.

Embodiment 22

The earth-boring tool of Embodiment 21, wherein the earth-boring tool comprises an earth-boring rotary drill bit.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A polycrystalline diamond compact (PDC) cutting element, comprising:

a substrate; and a volume of polycrystalline diamond attached to the substrate, comprising:

microdiamond grains forming an at least partially discontinuous phase of the volume of polycrystalline diamond; and nanodiamond agglomerates an at least substantially continuous phase of the volume of polycrystalline diamond, each nanodiamond agglomerate including a plurality of nanodiamond grains agglomerated together, the microdiamond grains and the nanodiamond agglomerates inter-bonded directly together by diamond-to-diamond bonds, the inter-bonded microdiamond grains and nanodiamond agglomerates being at least substantially free of metal solvent catalyst;

wherein a volume percentage of the nanodiamond agglomerates in the volume of polycrystalline diamond is greater than or equal to a percolation threshold volume of the nanodiamond agglomerates in the volume of polycrystalline diamond, and a remainder of the volume of polycrystalline diamond is at least substantially comprised by the microdiamond grains, and wherein the volume of polycrystalline diamond comprises at least about ninety-six percent by volume (96 vol %) diamond.

2. The PDC cutting element of claim 1, wherein the nanodiamond agglomerates comprise at least about ten percent by volume (10 vol %) of the PDC.

3. The PDC cutting element of claim 1, wherein the nanodiamond agglomerates comprise at least about twenty percent by volume (20 vol %) of the PDC.

4. The PDC cutting element of claim 1, wherein the microdiamond grains have a mean particle size of between about one micron (1 μm) and about thirty microns (30 μm).

5. The PDC cutting element of claim 1, wherein the nanodiamond grains of the diamond agglomerates have a mean particle size of between about ten nanometers (10 nm) and about five hundred nanometers (500 nm).

6. The PDC cutting element of claim 1, wherein the nanodiamond grains comprise crushed nanodiamond grains.

7. The PDC cutting element of claim 1, wherein the nanodiamond grains comprise detonation nanodiamond grains.

8. The PDC cutting element of claim 7, wherein the nanodiamond agglomerates have a mean agglomerate size within about twenty-five percent (25%) of a mean particle size of the microdiamond grains.

9. The PDC cutting element of claim 1, wherein the nanodiamond agglomerates have a mean agglomerate size within about fifty percent (50%) of a mean particle size of the microdiamond grains.

10. A method of fabricating a polycrystalline diamond compact (PDC), comprising:

forming a mixture comprising diamond grains and nanodiamond agglomerates, the mixture being substantially free of a metal solvent catalyst material, each nanodiamond agglomerate comprising a plurality of nanodiamond grains agglomerated together; and subjecting the mixture comprising diamond grains and nanodiamond agglomerates to a high-temperature/high-pressure (HTHP) sintering process to form the PDC without any substantial assistance from a from the metal solvent catalyst material, the HTHP sintering process resulting in formation of diamond-to-diamond inter-granular bonds between the diamond grains to define a diamond matrix, the nanodiamond agglomerates disposed within interstitial spaces between the inter-bonded diamond grains of the diamond matrix, a volume percentage of the nanodiamond agglomerates in the PDC being greater than or equal to a percolation threshold volume of the nanodiamond agglomerates in the PDC, a remainder of the volume of the PDC being at least substantially comprised by the diamond matrix.

11. The method of claim 10, wherein subjecting the mixture to the HTHP sintering process comprises subjecting the mixture to temperatures between about 1,400° C. and about 1,800° C. and pressures between about 5.0 GPa and about 10.0 GPa.

12. The method of claim 11, wherein subjecting the mixture to the HTHP sintering process comprises subjecting the mixture to temperatures between about 1,400° C. and about 1,600° C. and pressures between about 5.0 GPa and about 7.5 GPa.

13. The method of claim 10, further comprising forming the PDC to comprise at least about ninety-six percent by volume (96 vol %) diamond.

14. The method of claim 10, further comprising forming the PDC such that the nanodiamond agglomerates comprise at least about ten percent by volume (10 vol %) of the PDC.

15. The method of claim 14, further comprising forming the PDC such that the nanodiamond agglomerates comprise a volume of the PDC equal to or greater than a percolation threshold volume of the PDC.

16. The method of claim 10, further comprising selecting the diamond grains to have a mean particle size of between about one micron (1 μm) and about thirty microns (30 μm).

17. The method of claim 10, further comprising selecting the nanodiamond grains of the diamond agglomerates to have a mean particle size of between about ten nanometers (10 nm) and about five hundred nanometers (500 nm).

18. An earth-boring tool, comprising:

a body; and a polycrystalline diamond compact (PDC) cutting element secured to the body, the PDC cutting element including:

a substrate; and a volume of polycrystalline diamond attached to the substrate, comprising:

microdiamond grains forming an at least partially discontinuous phase within the volume of polycrystalline diamond; and nanodiamond agglomerates forming an at least substantially continuous phase within the volume of polycrystalline diamond, each nanodiamond agglomerate comprising a plurality of nanodiamond grains agglomerated together, the microdiamond grains and the nanodiamond agglomerates inter-bonded directly together by diamond-to-diamond bonds, the inter-bonded microdiamond grains and nanodiamond agglomerates being at least substantially free of metal solvent catalyst;

wherein a volume percentage of the nanodiamond agglomerates in the volume of polycrystalline diamond is greater than or equal to a percolation threshold volume of the nanodiamond agglomerates in the volume of polycrystalline diamond, and a remainder of the volume of polycrystalline diamond is at least substantially comprised by the diamond matrix, and wherein the volume of polycrystalline diamond comprises at least about ninety-six percent by volume (96 vol %) diamond.

* * * * *